US005927856A

United States Patent [19]

Hung

[11] Patent Number: 5,927,856

[45] Date of Patent: Jul. 27, 1999

[54] APPARATUS FOR STRETCHING THE MOUTH OF A BAG

[76] Inventor: Chin-Wang Hung, No. 62, Lane 155, Chung-Hua Rd., Yung-Kang City, Tainan Hsien, Taiwan

[21] Appl. No.: 09/046,453

[22] Filed: Mar. 23, 1998

[51] Int. Cl.[6] ..... B65D 33/02

[52] U.S. Cl. ..... 383/34; 150/120; 248/99

[58] Field of Search ..... 383/34, 34.1; 150/120, 150/121, 122, 123, 124, 125, 126; 248/99, 100, 101

[56] References Cited

U.S. PATENT DOCUMENTS

| | | | |
|---|---|---|---|
| 466,814 | 1/1892 | Weltmer | 383/34 |
| 524,908 | 8/1894 | Nathan | 150/123 |
| 533,743 | 2/1895 | Prahar | 150/123 |
| 4,368,767 | 1/1983 | Friedman | 150/120 |
| 4,537,377 | 8/1985 | Shewchuk | 248/99 |
| 5,451,107 | 9/1995 | Ricker | 383/34 |

*Primary Examiner*—Stephen P. Garbe
*Attorney, Agent, or Firm*—Ladas & Parry

[57] ABSTRACT

A stretching apparatus includes two U-shaped frames and two pivot couplers which pivotally interconnect joint ends of the U-shaped frames. At least one coupler includes a U-shaped pivot seat and a slider. The pivot seat has two opposite upright walls and a bottom bight portion. Two adjacent joint ends of the U-shaped frames are pivotally connected to the pivot seat adjacent to the bottom bight portion to prevent downward pivotal movement of the U-shaped frames toward one another. The opposite upright walls have two pairs of positioning holes above the bottom bight portion. One of the walls has a perpendicularly extending extension plate. The slider has two insert portions and is mounted on the extension plate to move between a first position, wherein the insert portions extend through the aligned positioning holes so as to press the adjacent joint ends against upward turning movement of the U-shaped frames, and a second position, wherein the insert portions move away from the respective one of the pairs of the aligned positioning holes.

6 Claims, 6 Drawing Sheets

APPARATUS FOR STRETCHING THE MOUTH OF A BAG

BACKGROUND OF THE INVENTION

1. Field of the Invention

This invention relates to an apparatus for stretching the mouth of a bag, more particularly to a stretching apparatus that can prevent unintentional closing of the mouth of a bag.

2. Description of the Related Art

Referring to FIGS. 1 and 2, a conventional bag 2 is shown to comprise a mouth 20, several side pockets 21, two handle straps 22, a zipper 23 provided on the mouth 20, and a stretching apparatus 3 mounted adjacent to the mouth 20. The stretching apparatus 3 includes two U-shaped frames 31 and two pivot couplers 32 which interconnect pivotally the U-shaped frames 31 in order to form a loop frame. When the U-shaped frames 31 are unfolded, the mouth 20 is stretched in an open state, as best illustrated in FIG. 1. To close the mouth 20, the U-shaped frames 31 are pivoted toward one another about the pivot couplers 31, and the zipper 23 is then sealed. Unintentional closing of the mouth 20 can occur in the conventional bag 2 because undesired pivotal movement of the U-shaped frames 32 cannot be prevented when the mouth 20 is opened.

SUMMARY OF THE INVENTION

The object of the present invention is to provide a stretching apparatus that can prevent unintentional closing of the mouth of a bag.

According to the present invention, the stretching apparatus comprises two U-shaped frames and two pivot couplers. Each of the U-shaped frames has two joint ends. The pivot couplers interconnect pivotally the joint ends of the U-shaped frames in order to form a loop frame. At least one of the pivot couplers includes a pivot seat of U-shaped cross-section, a slider and a positioning member.

The pivot seat has two spaced apart opposite upright walls and a bottom bight portion interconnecting the opposite upright walls. Two adjacent ones of the joint ends of the U-shaped frames are connected pivotally to the pivot seat between the opposite upright walls adjacent to the bottom bight portion so as to prevent downward pivotal movement of the U-shaped frames toward one another. The opposite upright walls have two spaced apart pairs of aligned positioning holes above the bottom bight portion, and two spaced apart pairs of aligned pivot holes formed between the aligned positioning holes and the bottom bight portion. One of the opposite upright walls has an extension plate extending substantially perpendicularly therefrom.

The slider has a proximal end adjacent to one of the upright walls, a distal end opposite to the proximal end, and two insert portions extending from the proximal end of the slider toward one of the upright walls. The slider is mounted on the extension plate to move between a first position and a second position. In the first position, each of the insert portions extends through a respective one of the pairs of the aligned positioning holes so as to press the adjacent joint ends of the U-shaped frames against upward turning movement of the adjacent joint ends of the U-shaped members. In the second position, each of the insert portions moves away from the respective one of the pairs of the aligned positioning holes.

The positioning member is connected pivotally to the slider, and engages releaseably the extension plate to prevent the slider from being released from the extension plate.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
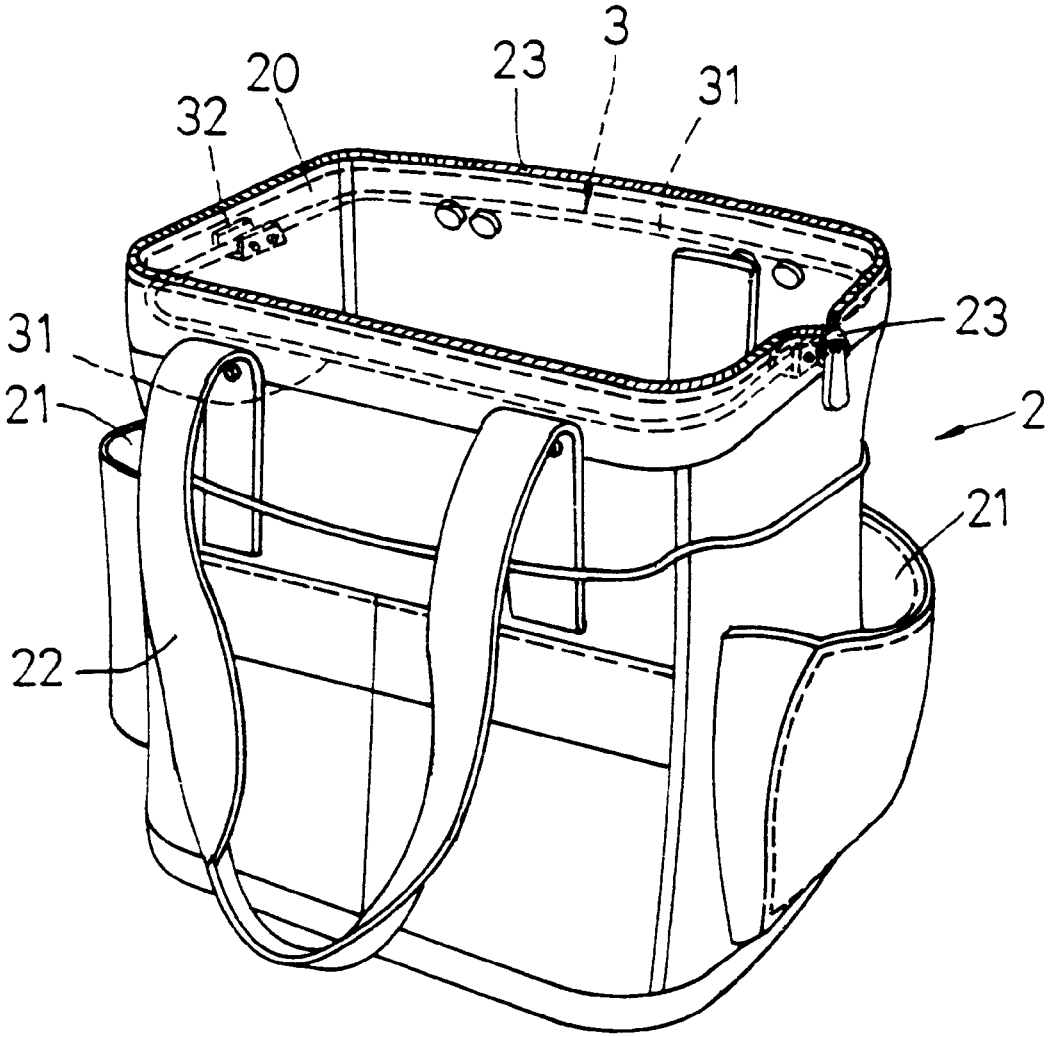
FIG.1 PRIOR ART
FIG. 1 is a perspective view of a conventional bag with an apparatus for stretching the mouth of a bag.
Figure 2:
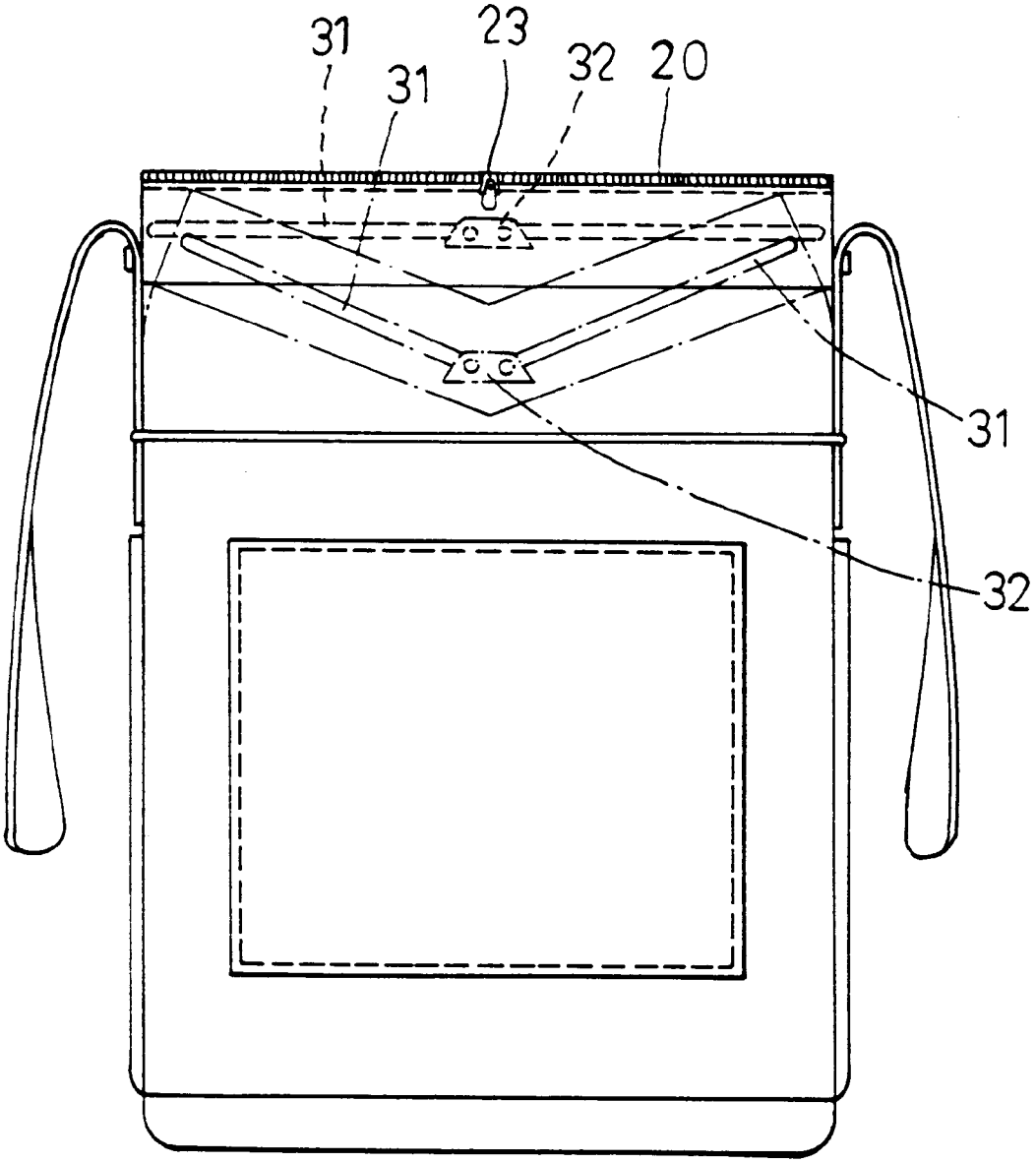
FIG.2 PRIOR ART
FIG. 2 is a schematic view illustrating how the mouth of the bag is closed by turning the U-shaped frames of the stretching apparatus in FIG. 1.
Figure 3:
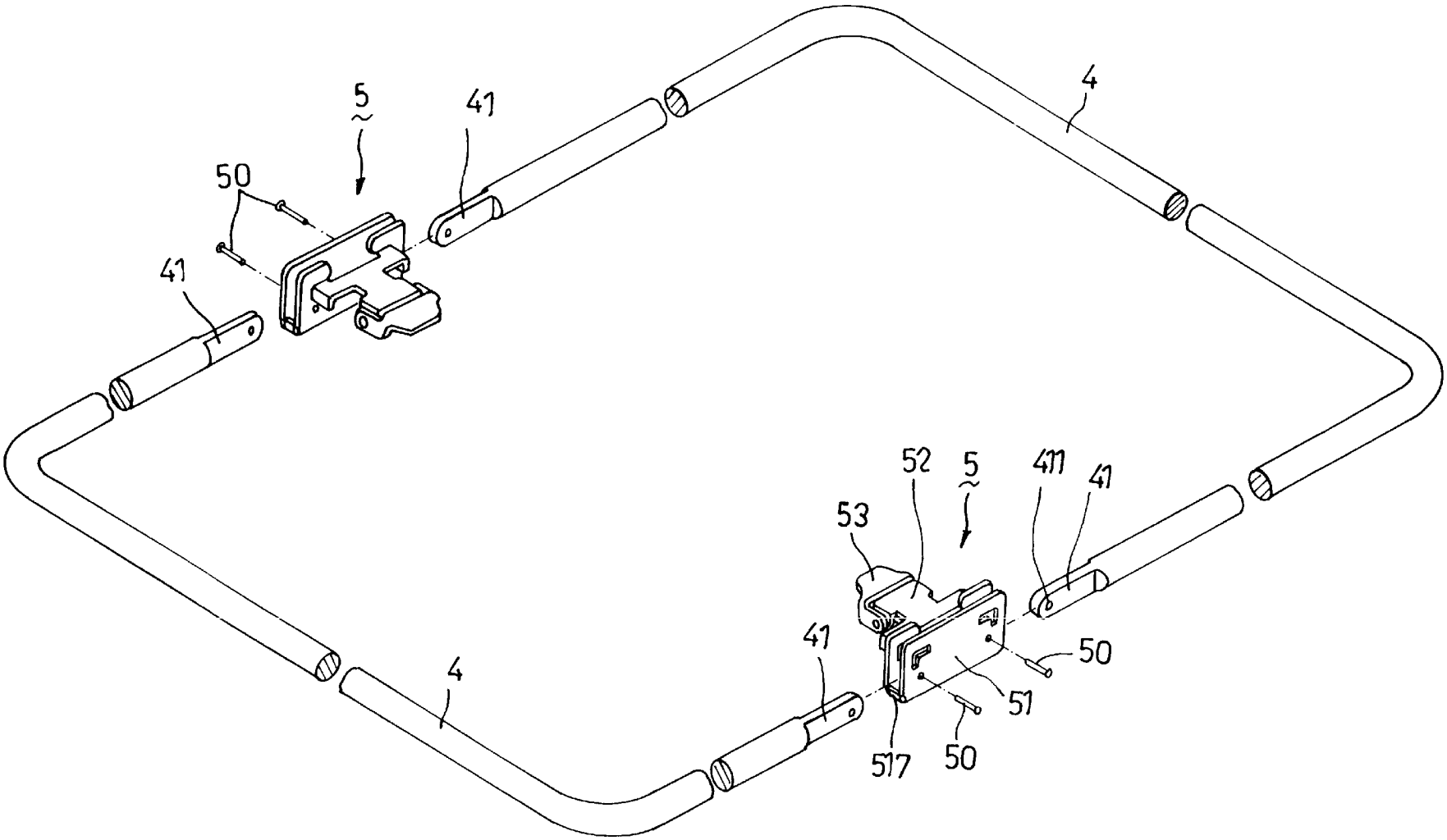
FIG. 3 is an exploded view of a preferred embodiment of an apparatus for stretching the mouth of a bag according to the present invention.

Referring to FIG. 3, a preferred embodiment of an apparatus for stretching the mouth of a bag according to the present invention is shown to comprise two U-shaped frames 4 and two pivot couplers 5. Each of the U-shaped frames 4 has two flat joint ends 41. Each of the joint ends 41 has a hole 411 formed therein. The pivot couplers 5 interconnect pivotally the joint ends 41 of the U-shaped frames 4 in order to form a loop frame. Each of the pivot couplers 5 includes a pivot seat 51 of U-shaped cross-section, a slider 52 and a positioning member 53.

Figure 4:
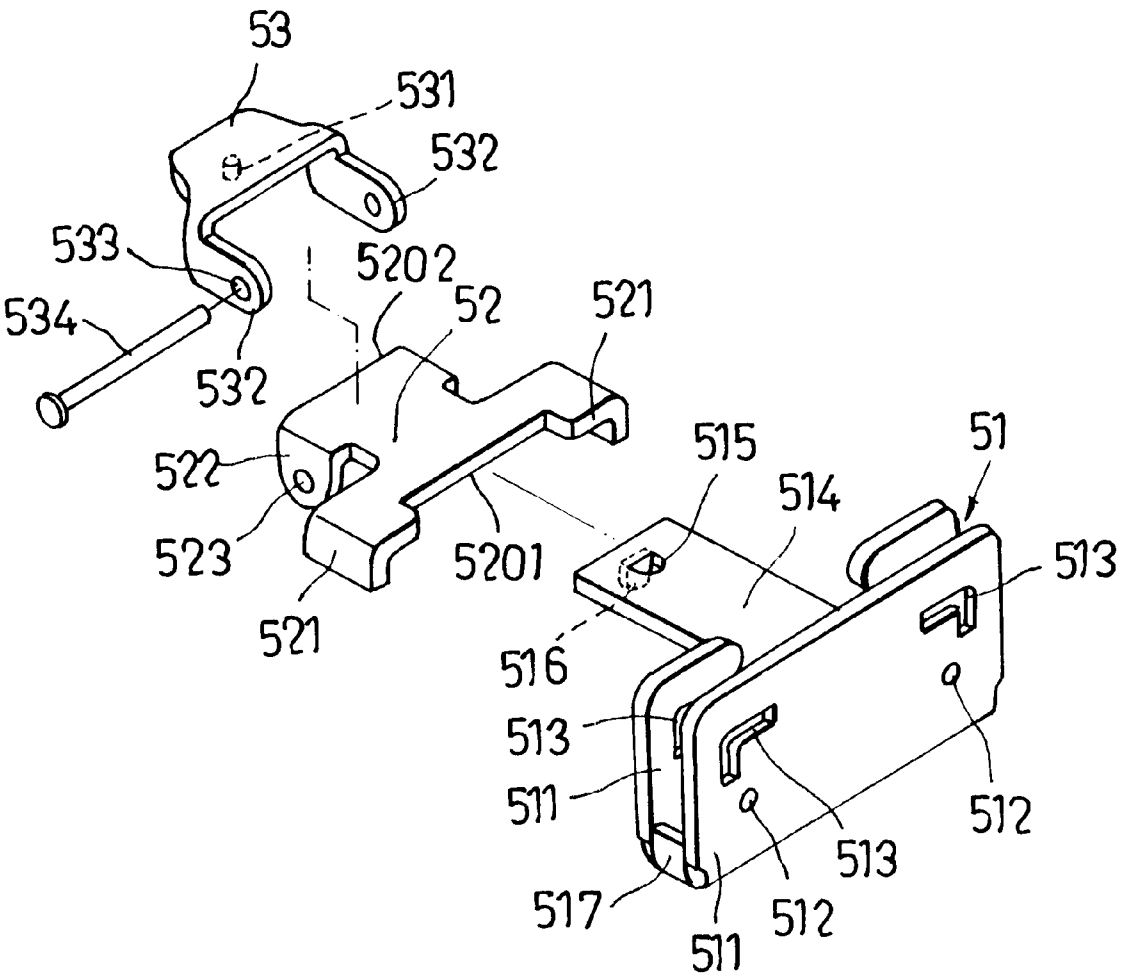
FIG. 4 is an exploded view of a pivot coupler of the stretching apparatus of the preferred embodiment.
Figure 5:
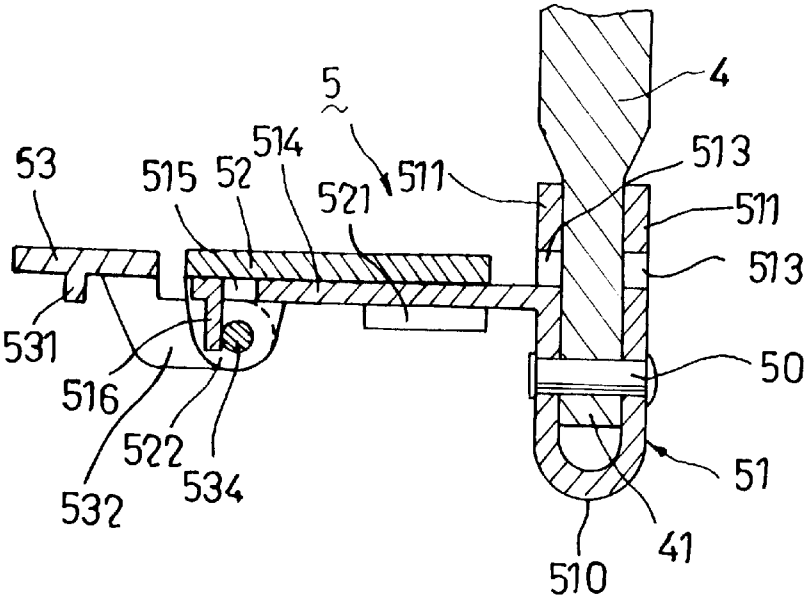
FIG. 5 is a sectional schematic view illustrating the coupler in an unlocked position.

Referring to FIGS. 3, 4 and 5, the pivot seat 51 has two spaced apart opposite upright walls 511 and a bottom bight portion 510 interconnecting the opposite upright walls 511. Two upwardly extending abutting portions 517 are formed respectively on said opposed ends of the bottom bight portion 510 between the opposite upright walls 511. Two adjacent ones of the joint ends 41 of the U-shaped frames 4 are connected pivotally to the pivot seat 51 between the opposite upright walls 511 adjacent to the bottom bight portion 510 by two rivets 50. The rivets 50 extend through two spaced apart pairs of aligned pivot holes 512 in the opposite upright walls 511 above the top edges of the abutting portions 517, and extend through the holes 411 of the joint ends 41. The downward pivotal movement of the U-shaped frames 4 toward one another is prevented as the lower edges of the U-shaped frames 4 abut against the top edges of the abutting portions 517. The opposite upright walls 511 have two spaced apart pairs of aligned positioning holes 513 above the aligned pivot holes 512. Each of the aligned positioning holes 513 is substantially L-shaped. One of the opposite upright walls 511 has an extension plate 514 extending substantially perpendicularly therefrom.

The extension plate 514 has a retaining hole 515 formed adjacent to the distal end thereof, and a stop tab 516 extending downwardly from the extension plate 514 adjacent to the retaining hole 515 and formed by means of a punching process.

Figure 7:
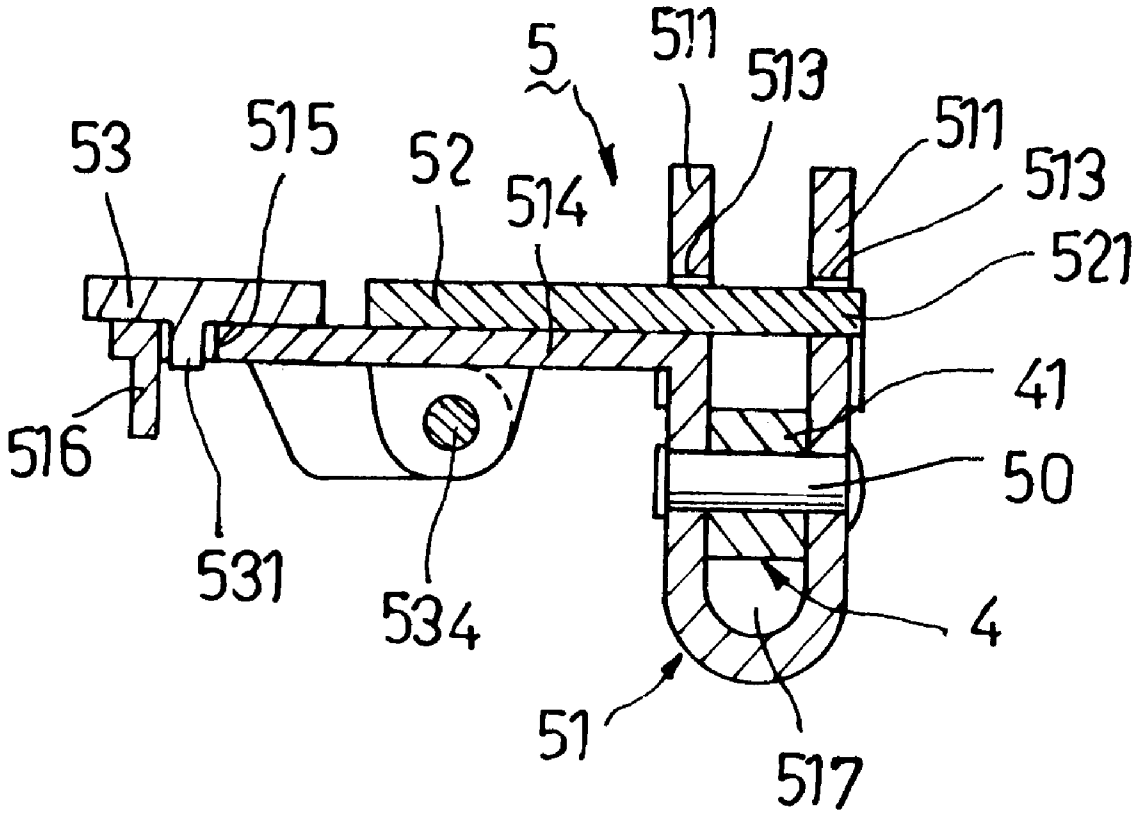
FIG. 7 is a sectional schematic view illustrating the coupler in a locked position.

The slider 52 has a proximal end 5201 adjacent to one of the upright walls 511, a distal end 5202 opposite to the proximal end 5201, and two insert portions 521 of substantially L-shape extending from the proximal end 5201 of the slider 52 toward one of the upright walls 511. A spaced pair of first lugs 522 extend downward from the distal end 5202 of the slider 52 and has two aligned pivot holes 523 formed therein. The slider 52 is mounted slidably on the extension plate 514 to move between a first position and a second position. In the first position, each of the insert portions 521 extends through a respective one of the pairs of the aligned positioning holes 513 so as to press the lower portions of adjacent joint ends 41 of the U-shaped frames 4 against upward turning movement of the adjacent joint ends 41 of the U-shaped members 4, as best illustrated in FIG. 7. Therefore, when the U-shaped frames 4 are mounted on the mouth of a bag, the mouth can be stretched open by the U-shaped frames 4 and can be prevented from unintentional closing by means of the sliders 52 of the pivot couplers 5. On the other hand, in the second position, each of the insert portions 521 moves away from the respective one of the pairs of the aligned positioning holes 513, as best illustrated in FIG. 5. As such, the mouth of the bag can be closed or opened freely.

The positioning member 53 is connected pivotally to the slider 52, and engages releaseably the extension plate 514 to prevent the slider 52 from being released from the extension plate 514. More specifically, the positioning member 53 has two spaced second lugs 532, and a pivot pin 534 extending through the first and second lugs 522, 532 to connect pivotally the positioning member 53 to the slider 52. The positioning member 53 further has a protrusion 531 which extends into the retaining hole 515 of the extension plate 514 when the slider 52 is moved to the second position. The pivot pin 534 abuts against the stop tab 516 of the extension plate 514 to prevent the slider 52 from being released from the extension plate 514. When it is desired to move the slider 52 from the first position to the second position, the positioning member 53 can be bent upward from one end thereof for removal of the protrusion 531 from the retaining hole 515, thus resulting in relative movement between the slider 52 and the extension plate 514. Accordingly, when the slider 52 is moved from the second position to the first position, the protrusion 531 snaps into and engages the retaining hole 515.

Figure 6:
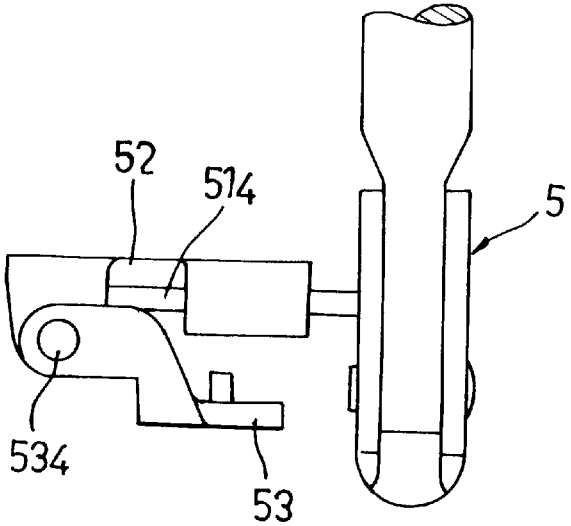
FIG. 6 is a side view illustrating a positioning member of the coupler in a folded position.

Preferably, with reference to FIG. 6, when the slider 52 is moved to the second position, the positioning member 53 can turn downward about the pivot pin 534 in order to reduce the overall length of the pivot coupler 5 that extends into the mouth of the bag.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An apparatus for stretching a mouth of a bag, comprising:

two U-shaped frames, each having two joint ends; and two pivot couplers interconnecting pivotally said joint ends of said U-shaped frames in order to form a loop frame, at least one of said pivot couplers including:

a pivot seat of U-shaped cross-section having two spaced apart opposite upright walls and a bottom bight portion interconnecting said opposite upright walls, two adjacent ones of said joint ends of said U-shaped frames being connected pivotally to said pivot seat between said opposite upright walls adjacent to said bottom bight portion so as to prevent downward pivotal movement of said U-shaped frames toward one another, said opposite upright walls having two spaced apart pairs of aligned positioning holes above said bottom bight portion and two spaced apart pairs of aligned pivot holes formed between said aligned positioning holes and said bottom bight portion, one of said opposite upright walls having an extension plate extending substantially perpendicularly therefrom;

a slider having a proximal end adjacent to said one upright wall, a distal end opposite to said proximal end, and two insert portions extending from said proximal end of said slider toward said one upright wall, said slider being mounted on said extension plate to move between a first position, wherein each of said insert portions extends through a respective one of said pairs of said aligned positioning holes so as to press said adjacent joint ends of said U-shaped frames against upward turning movement of said adjacent joint ends of said U-shaped members, and a second position, wherein each of said insert portions moves away from the respective one of said pairs of said aligned positioning holes; and a positioning member connected pivotally to said slider and engaging releaseably said extension plate to prevent said slider from being released from said extension plate.

2. The apparatus as claimed in claim 1, wherein said bottom bight portion of said pivot seat has two opposed ends and two upwardly extending abutting portions formed respectively on said opposed ends of said bottom bight portion between said opposite upright walls.

3. The apparatus as claimed in claim 1, wherein each of said aligned positioning holes in said opposite upright walls is substantially L-shaped, each of said insert portions of said slider being L-shaped in cross-section in order to fit in a corresponding one of said pairs of said aligned positioning holes.

4. The apparatus as claimed in claim 1, wherein said extension plate has a distal end with a retaining hole formed therein, and a stop tab extending downwardly from said extension plate adjacent to said retaining hole.

5. The apparatus as claimed in claim 4, wherein said slider has a spaced pair of first lugs extending downwardly adjacent to said distal end thereof.

6. The apparatus as claimed in claim 5, wherein said positioning member has two spaced second lugs, a pivot pin extending through said first and second lugs to connect pivotally said positioning member to said slider, and a protrusion which extends into said retaining hole of said extension plate when said slider is moved to said second position, said pivot pin abutting against said stop tab of said extension plate to prevent said slider from being released from said extension plate.

* * * * *